US005502542A

United States Patent [19]

Takano

[11] Patent Number: 5,502,542

[45] Date of Patent: Mar. 26, 1996

[54] IMAGE-FORMING APPARATUS WITH AN EXPOSURE-LIGHT INTENSITY ADJUSTING FUNCTION FOR A TWO-SIDED ORIGINAL

[75] Inventor: Shouji Takano, Kanagawa, Japan

[73] Assignee: Kabushiki Kaisha Toshiba, Kawasaki, Japan

[21] Appl. No.: 317,584

[22] Filed: Oct. 3, 1994

[30] Foreign Application Priority Data

Dec. 29, 1993 [JP] Japan ..... 5-351000

[51] Int. Cl.[6] ..... G03G 27/72; G03G 21/00

[52] U.S. Cl. ..... 355/69; 355/311; 355/320; 355/321; 355/208

[58] Field of Search ..... 355/311, 308, 355/316, 318, 320, 321, 228, 229, 208, 207, 69, 23, 24

[56] References Cited

U.S. PATENT DOCUMENTS 4,714,945 12/1987 Fujiwara et al. ..... 355/69

5,005,049 4/1991 Matsushita ..... 355/208

*Primary Examiner*—Matthew S. Smith

*Attorney, Agent, or Firm*—Foley & Lardner

[57] ABSTRACT

An image-forming apparatus includes a platen on which an original is placed so that a first surface of the original is positioned at an exposure area, a first sensor for detecting that a second surface of the original which is the opposite surface to the first surface has an image, and a second sensor for detecting the transmittance of the original. The image-forming apparatus also has an exposure lamp which is arranged near the platen to expose the first surface positioned at the exposure area, a voltage source coupled to the exposure lamp, a control unit for adjusting the voltage applied from the voltage source to exposure lamp corresponding to the transmittance in the case that the first sensor detects that the second surface has an image, and an image-forming unit for forming a copying image on the basis of the light image.

2 Claims, 14 Drawing Sheets

IMAGE-FORMING APPARATUS WITH AN EXPOSURE-LIGHT INTENSITY ADJUSTING FUNCTION FOR A TWO-SIDED ORIGINAL

BACKGROUND OF THE INVENTION

1. Field of the Invention

The present invention relates to an image-forming apparatus having an image-forming unit for forming a copying image on the basis of an exposed image of an original. More specifically, the invention relates to an image-forming apparatus with an exposure-light intensity adjusting function for preventing an image on an opposite surface from being formed as the copying image.

2. Description of the Related Art

Recently, both sides of an original are being provided with images to use the resources effectively in consideration of environmental problems. If the transmittance of the two-sided original is high when an image-forming apparatus, e.g., a plain paper copying machine, makes a copying image, then the image of the opposite side may be copied with the image of the front side. Thus, an operator has to adjust an exposure light intensity manually so that the image of the opposite side is not copied.

Many plain paper copying machines have an automatic copy density control function, as disclosed in U.S. Pat. No. 4,573,787. This function is useful to regulate the density of a copying image even if each density of originals differs from each other. However, this function is not helpful to prevent an image on the opposite surface from being copied.

SUMMARY OF THE INVENTION

It is therefore an object of the present invention to provide an improved image-forming apparatus.

It is a particular object of the present invention to provide an image-forming apparatus with an exposure-light intensity adjusting function for preventing an image on an opposite surface from being copied.

Another object of the present invention is to provide an improved image-forming method.

In accordance with one aspect of the present invention, the foregoing objects, among others, are achieved by providing an image-forming apparatus, having a platen on which an original is placed so that a first surface of the original is positioned at an exposure area, first detecting means for detecting that a second surface of the original which is the opposite surface to the first surface has an image, and second detecting means for detecting the transmittance of the original. The image-forming apparatus also has means for exposing the first surface positioned at the exposure area by emitting a light to make a light image, means for adjusting an intensity of the light emitted by the exposure means corresponding to the transmittance when the first detecting means detects that the second surface has an image, and means for forming a copying image on the basis of the light image.

In accordance with another aspect of the present invention, there has been provided an image-forming apparatus, having a platen on which an original is placed so that a first surface of the original is positioned at an exposure area, a first sensor for detecting that a second surface of the original which is the opposite surface to the first surface has an image, and a second sensor for detecting the transmittance of the original. The image-forming apparatus also has an exposure lamp which is arranged near the platen to expose the first surface positioned at the exposure area, a voltage source coupled to the exposure lamp, a control unit for adjusting the voltage applied from the voltage source to the exposure lamp corresponding to the transmittance in the case that the first sensor detects that the second surface has an image, and an image-forming unit for forming a copying image on the basis of the light image.

In accordance with still another aspect of the present invention, there has been provided an image-forming method for forming a copying image in accordance with an image on a first surface of an original, including the steps of detecting that a second surface of the original which is the opposite surface to the first surface, has an image, detecting a transmittance of the original, exposing the first surface positioned at the exposure area by emitting a light to make a light image, adjusting an intensity of the light emitted corresponding to the transmittance when the second surface has an image, and forming a copy image on the basis of the light image.

BRIEF DESCRIPTION OF THE DRAWINGS

A more complete appreciation of the present invention and many of the attendant advantages thereof will be readily obtained as the invention becomes better understood by reference to the following detailed description, when considered in connection with the accompanying drawings, wherein.

DETAILED DESCRIPTION OF THE PREFERRED EMBODIMENTS

Figure 1:
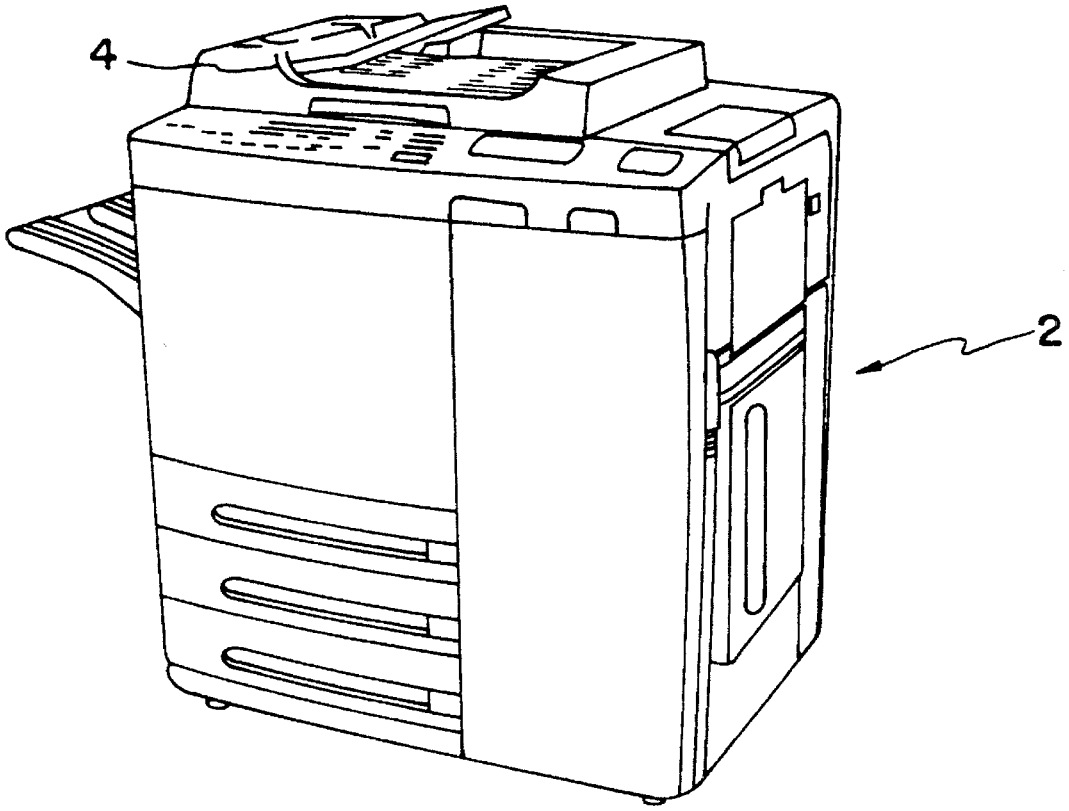
FIG. 1 is a perspective view of the image-forming apparatus of an embodiment of the present invention.
Figure 2:
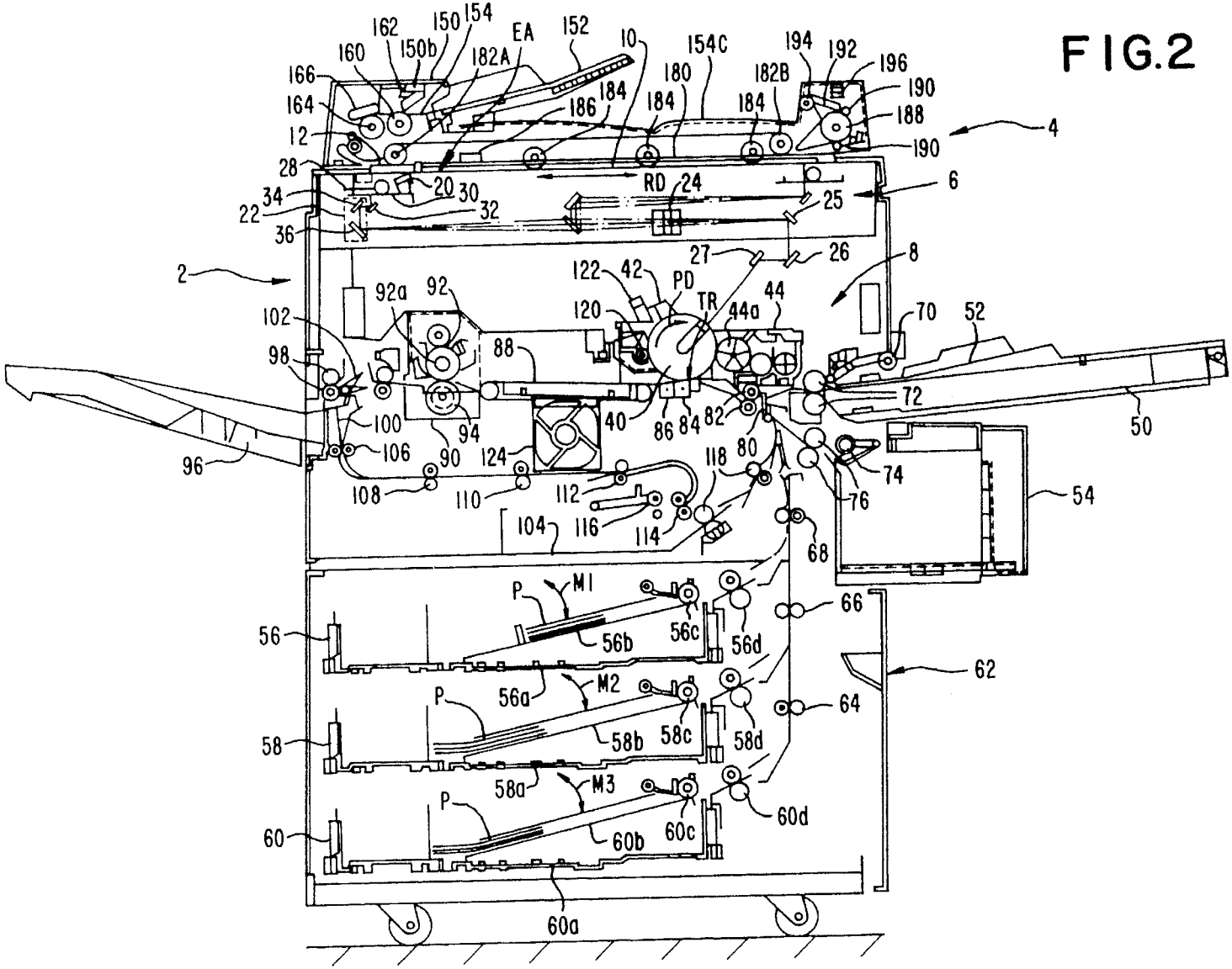
FIG. 2 is a sectional view of the image-forming apparatus shown in FIG. 1.

FIGS. 1 and 2 show a copying machine 2 as an image-forming apparatus according to an embodiment of the present invention, with an automatic-document feeder 4. Copying machine 2 includes an image-scanning portion 6 at the upper portion thereof, and an image-forming portion 8 at the central portion thereof.

A platen 10 which is a transparent material such as glass, is fixed on the upper surface of image-scanning portion 6. Automatic-document feeder 4 is removable and can be positioned to cover or not cover platen 10. A scale 12 useful for indicating a position to be placed and for positioning an original D, is fixed at one end of platen 10 along the longitudinal direction thereof. The lower surface of the original D positioned in this way is in an exposure area EA.

Original D placed on platen 10 is scanned for image exposure by image-scanning portion 6. As shown in FIG. 2, image-scanning portion 6 includes a first carriage 20, a second carriage 22, a lens block 24 for focusing the light from original D (either unmagnified, magnified or reduced), and mirrors 25, 26, 27. First carriage 20 includes an exposure lamp 28, a reflector 30 for reflecting the light from exposure lamp 28 to platen 10 and a mirror 32. Second carriage 22 includes a mirror 34 and a mirror 36. When image-scanning portion 6 scans original D, the lower surface of original D is exposed by exposure lamp 28 while first carriage 20 and second carriage 22 reciprocate in the direction indicated by an arrow RD along the under surface of platen 10. In this case, second carriage 22 moves at a speed half that of first carriage 20 in order to maintain a fixed optical path length.

A reflected light beam from original D scanned by image-scanning portion 6 is reflected by mirror 32, mirror 34, and mirror 36, transmitted through lens block 24 and then reflected by mirrors 25, 26, 27 to be directed on a photosensitive drum 40 in image-forming portion 8. Thus, an electrostatic latent image of original D is formed on the surface of photosensitive drum 40.

Image-forming portion 8 forms an image corresponding to the reflected light image and includes photosensitive drum 40. Photosensitive drum 40 is rotated by a motor (not shown) in the direction indicated by an arrow PD so that its surface is wholly charged first by a main charger 42 so that a potential of the circumferential surface is preferably about +700V to +800V. The image of original D is projected on the charged surface of photosensitive drum 40 by slit exposure, forming the electrostatic latent image on the surface. The exposure light quantity of exposure lamp 28 is changed corresponding to the transmittance of original D when there are images on both sides of original D, as described later.

The electrostatic latent image is developed into a visible image which is a toner image, by a developing roller 44*a* of a developing unit 44 using a two component developing agent including toner. The average diameter of the toner is about 6 μm to 15 μm. The toner is previously charged at about −10 μc/g to −40 μc/g. A bias voltage provided to developing roller 44*a* is about −500 V.

Each paper sheet P as an image record media is delivered one by one from one of a paper cassette 50, a paper tray 52 located on paper cassette 50, a large-capacity feeder 54, a paper cassette 56, a paper cassette 58, and a paper cassette 60. Paper cassette 50, paper cassette 58, and paper cassette 60 are removably arranged in a pedestal 62 of the copying machine 2. Paper cassette 56, paper cassette 58, and paper cassette 60 have a cassette case 56*a* and a movable plate 56*b*, a cassette case 58*a* and a movable plate 58*b*, and a cassette case 60*a* and a movable plate 60*b*, respectively. Paper sheets P are placed on movable plate 56*b*, movable plate 58*b*, and movable plate 60*b*. Each of movable plates 56*b*, 58*b*, and 60*b* is moved in the direction indicated by an arrow M1, an arrow M2, and an arrow M3, respectively. Before paper sheets P are picked up, movable plates 56*b*, 58*b*, and 60*b* are moved upward. Paper sheets P in paper cassettes 56, 58, and 60 are picked up by pick-up rollers 56*c*, 58*c*, and 60*c*, respectively, and transported to transport roller pairs 56*d*, 58*d*, and 60*d*, respectively. After that, paper sheets P are transported by transport roller pairs 64, 66, and/or 68.

On the other hand, a paper sheet P in paper cassette 50 and paper tray 52 is picked up by a pick-up roller 70, and transported by a transport roller pair 72. A paper sheet P in large-capacity feeder 54 is picked up by a pick-up roller 74, and transported by a transport roller pair 76. Each of transport roller pairs 56*d*, 58*d*, 60*d*, 72, and 76 is a conventional paper separating mechanism for transporting paper sheets P one by one and constructed by a transport roller and a separation roller.

A paper sheet P delivered from paper cassette 50, paper tray 52, large-capacity feeder 54, paper cassette 56, paper cassette 58, or paper cassette 60 is detected by an aligning switch 80 just upstream of aligning roller pair 82 in the transport direction of paper sheet P. Then, each paper sheet P is delivered to a transfer region TR by aligning roller pair 82 timed to the formation of the visible image on drum 40.

Paper cassette 50, paper tray 52, large-capacity feeder 54, paper cassettes 56, 58, and 60 can be alternatively selected by the operator using a control panel (not shown).

A paper sheet P delivered to transfer region TR comes into intimate contact with the surface of photosensitive drum 40, in the space between a transfer charger 84 which is a DC corona discharger and photosensitive drum 40. As a result, the toner image on photosensitive drum 40 is transferred to paper sheet P by the agency of transfer charger 84. After the transfer, paper sheet P is separated from photosensitive drum 40 by a separation charger 86 which is a vibratory (AC+DC) corona discharger and transported by a conveyor belt 88. Separation charger 86 removes the electrostatic force supplied between photosensitive drum 40 and paper sheet P in order to separate the paper sheet from photosensitive drum 40. Thereafter, paper sheet P is delivered to a fixing unit 90 arranged at the terminal end portion of conveyor belt 88 along a paper path. Fixing unit 90 includes a heat roller 92 which has a heater lamp 92*a* and a pressure roller 94 which is arranged in contact with heat roller 92. As paper sheet P passes a nip portion between heat roller 92 and pressure roller 94, the transferred image is fixed on paper sheet P. After the fixation, paper sheet P is discharged into a tray 96 outside a housing by exit roller pair 98.

If paper sheet P, however, is to have a two-sided copying or multiple copying, paper sheet P is sent, instead of being discharged directly to tray 96 through exit roller pair 98, into a retransporting path 100 by means of a gate unit 102. Gate unit 102 is arranged between fixing unit 90 and exit roller pair 98. Gate unit 102 guides paper sheet P to a paper tray 104. Paper-transport roller pairs 106, 108, 110, 112, and 114 transport paper sheet P to paper tray 104. After paper sheet P is transported to paper tray 104, paper sheet P is picked up by a pick-up roller 116, and transported to aligning roller pair 82 by a paper-transport roller pair 118. In this way, paper sheet P is transported to the transfer region again and the two-sided copy is performed.

After the transfer, moreover the residual toner on the surface of photosensitive drum 40 is removed by a cleaner 120. Thereafter, a residual latent image on photosensitive drum 40 is erased by a discharge lamp 122 to restore photosensitive drum 40 to its initial state. A cooling fan 124 for preventing the temperature inside the housing from rising is arranged at a lower, right portion of fixing unit 90.

Figure 3:
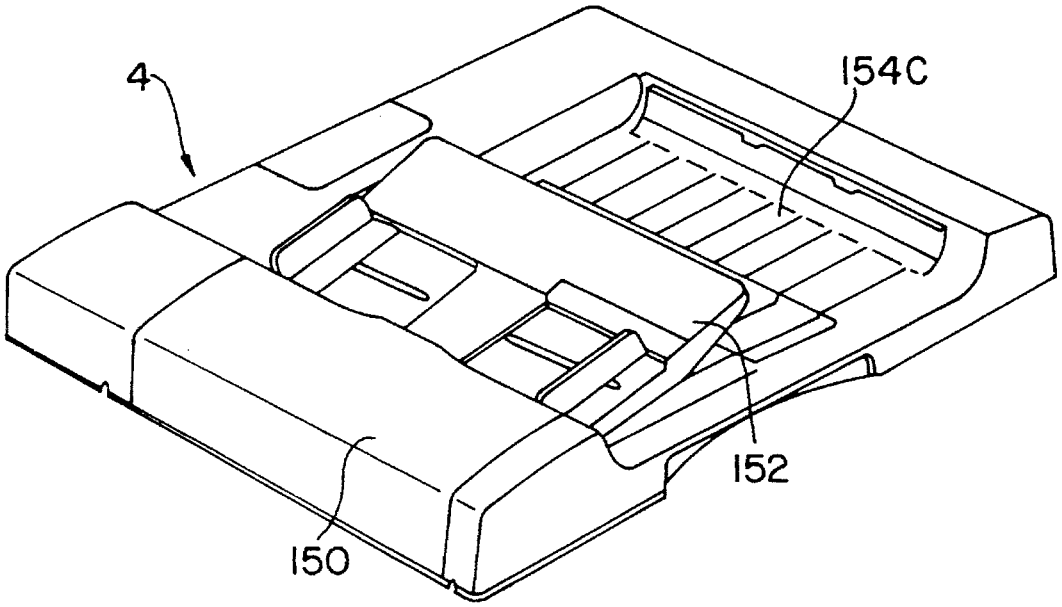
FIG. 3 is a perspective view of an automatic-document feeder attached at the upper portion of the image-forming apparatus.
Figure 4:
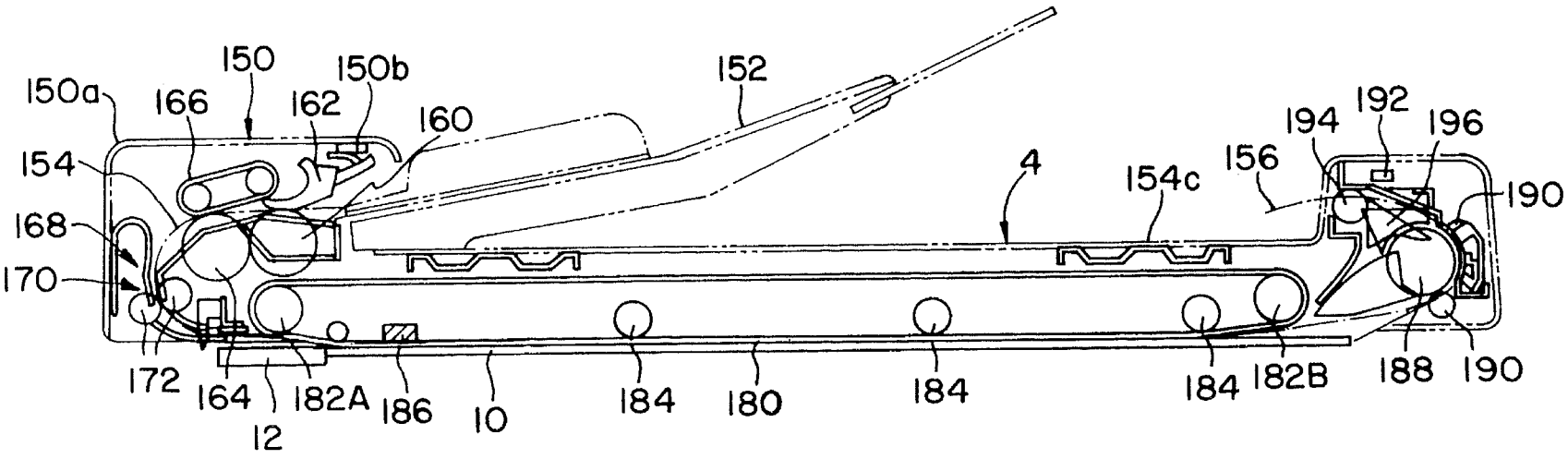
FIG. 4 is a sectional view of the automatic-document feeder shown in FIG. 3.

Automatic-document feeder 4 as shown in FIGS. 2, 3, and 4, includes a housing 150 and a tray 152 which stacks originals D, and feeds original D from tray 152 through a document-transport pass 154 defined by guides 154*a* and 154*b* onto platen 10. After original D has been scanned by image-scanning portion 6, automatic-document feeder 4 discharges the sheets of original D to a discharge portion 154*c* on housing 150 through a document-discharging pass 156, so that the original surface is up.

Figure 5:
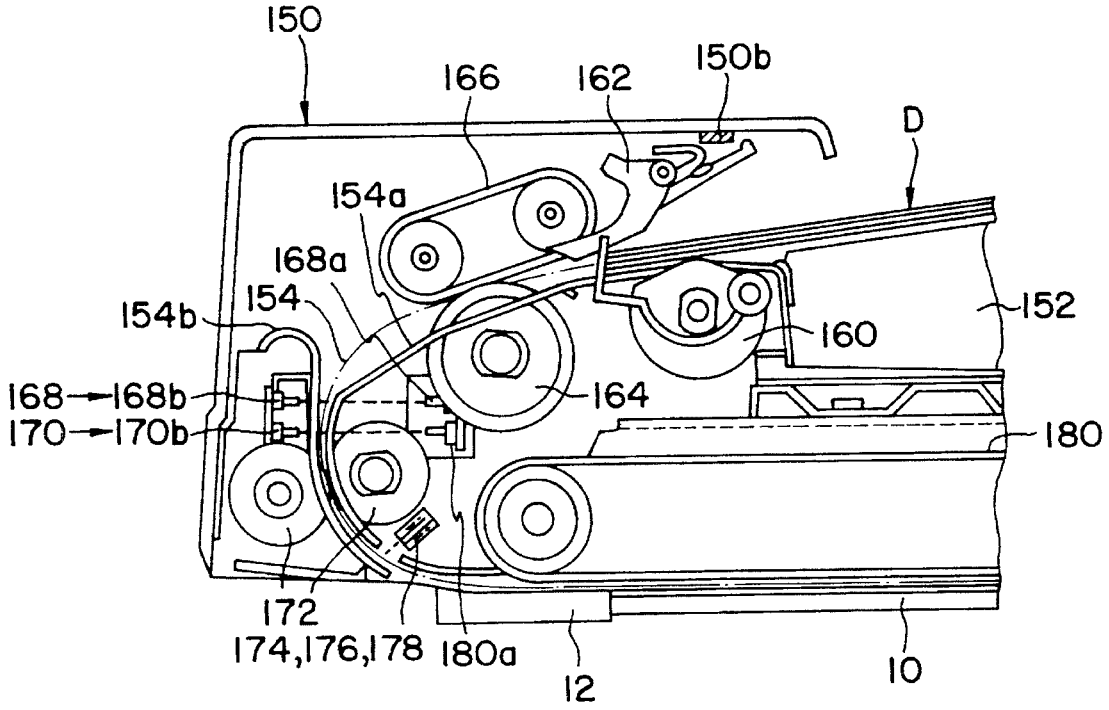
FIG. 5 is an enlarged view of a portion of the sectional view of FIG. 4.

As shown in FIGS. 4 and 5, a pick-up roller 160, a document-detecting sensor 162, a document-transport roller 164, a separation mechanism 166 for preventing document-transport roller 164 from transporting two or more originals D at the same time, are arranged along document-transport pass 154 in the document-transport direction.

Housing 150 includes a housing cover 150*a* which is arranged to removably cover these document-transporting mechanisms. When housing cover 150*a* is open, an operator is allowed to remove a jammed original in housing 150. A sensor 150*b* is arranged near housing cover 150*a* to detect when housing cover 150*a* is open. When sensor 150*b* detects this open condition, automatic-document feeder 4 does not work to transport original D.

An aligning sensor 168 and a transmittance sensor 170 are arranged just upstream of an aligning roller pair 172 along document transport pass 154. Aligning sensor 168 detects an original D. Transmittance sensor 170 detects the transmittance of an original D transported.

Image-detecting sensors 174, 176, and 178 are arranged downstream of aligning roller pair 172 along document transporting path 154, and arranged at predetermined intervals in the axial direction of aligning roller pair 172. Image-detecting sensors 174, 176, and 178 detect that an opposite surface of an original D has an image.

Pick-up roller 160 picks up an original D placed on tray 152. Document-transport roller 164 feeds the sheets of original D picked up by pick-up roller 160, one by one, to the downstream. Separation mechanism 166 prevents document-transport roller 164 from transporting a plurality of originals at the same time. The leading edge of original D is aligned by aligning roller pair 172 with aligning sensor 168, then original D is transported onto platen 10 while image-detecting sensors 174, 176, and 178 detect whether the opposite surface has an image, and transmittance sensor 170 detects the transmittance of original D. These mechanisms work only when document-detecting sensor 162 detects that original D is on tray 152.

A document-conveying belt 180 is stretched by belt rollers 182A and 182B to cover platen 10 on the bottom of automatic-document feeder 4. Document-conveying belt 180 is a white, wide, endless belt, and is driven in the forward and reverse directions by a belt-driving mechanism (not shown). A plurality of belt-retaining rollers 184 and a set switch 186 are arranged at the back side of the inner circumference of document-conveying belt 180. Belt-retaining rollers 184 press document-conveying belt 180 against platen 10 to transport each sheet of original D between document-conveying belt 180 and platen 10. Set switch 186 detects the trailing edge of an original sheet to position the sheet of original D to a suitable position. Original D transported by aligning roller pair 172 is positioned on platen 10 by document-conveying belt 180 so that one edge of original D is in contact with scale 12.

A document-transport roller 188, pinching rollers 190, a document-detecting sensor 192, and a discharging roller 194 are arranged along document-discharging pass 156 in the document-transport direction. Document transport roller 188 transports the sheet of original D which is transported by document-conveying belt 180 while pinching roller 190 presses that sheet of original D against document-transporting roller 188. Document-detecting sensor 192 detects the trailing edge of the sheet of original D to detect its discharge. Discharging roller 194 discharges the sheet of original D onto discharge portion 154*c*.

Furthermore, a gate 196 is arranged between document-transporting roller 188 and discharging roller 194. Gate 196 guides the sheet of original D to platen 10 so that an opposite surface of original D faces platen 10. In this case, document-conveying belt 180 is driven in the reverse direction.

In this embodiment, when automatic-document feeder 4 is used, transmittance sensor 170 detects the transmittance of an original D, and image-detecting sensors 174, 176, and 178 detect that an opposite surface of an original D has an image. If image-detecting sensors 174, 176, and 178 detect that an opposite surface of an original D has an image, then the exposure light quantity of exposure lamp 28 is changed corresponding to the transmittance of original D detected by transmittance sensor 170. The arrangement of transmittance sensor 170 and image-detecting sensors 174, 176, and 178 is described in detail.

Figure 6:
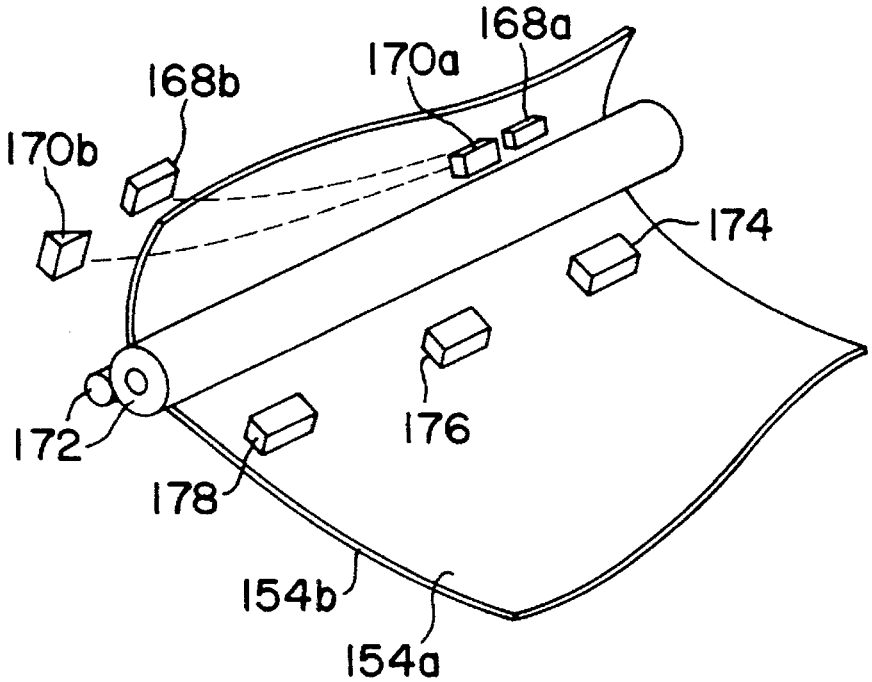
FIG. 6 is a perspective view schematically showing arrangements of an aligning sensor, a transmittance sensor and image-detecting sensors.
Figure 7:
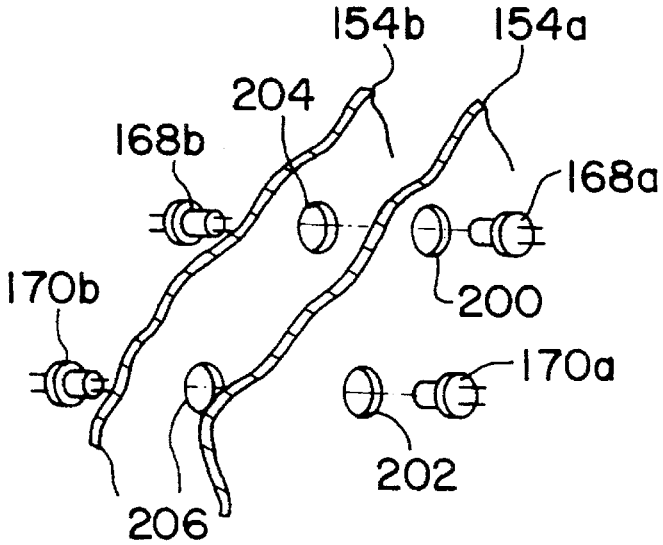
FIG. 7 is a perspective view schematically showing arrangements of the aligning sensor and the transmittance sensor.

As shown in FIGS. 5, 6 and 7, aligning sensor 168 includes a light-emitting diode 168*a* and a photo-transistor 168*b*, and transmittance sensor 170 includes a light-emitting diode 170*a* and a photo-transistor 170*b*. Light-emitting diode 168*a* and photo-transistor 168*b* are positioned near guides 154*a* and 154*b* so as to sandwich guides 154*a* and 154*b* between them. Light-emitting diode 170*a* and photo-transistor 170*b* are also positioned near guides 154*a* and 154*b* so as to sandwich guides 154*a* and 154*b* between them. Holes 200 and 202 are formed in guide 154*a*, and holes 204 and 206 are formed in guide 154*b*. The light emitted by light-emitting diode 168*a* reaches photo-transistor 168*b* through hole 200 in guide 154*a* and hole 204 in guide 154*b*. The light emitted by light-emitting diode 170*a* reaches photo-transistor 170*b* through hole 202 in guide 154*a* and hole 206 in guide 154*b*. When an original D guided by guides 154*a* and 154*b* passes between holes 200 and 204, the original D intercepts the light from light-emitting diode 168*a*. Thus, the output of photo-transistor 168*b* changes. In this way, aligning sensor 168 detects that an original D has come.

While an original D is between holes 202 and 206, the light quantity which reaches photo-transistor 170*b* corresponds to the transmittance of the original D. Therefore, the output of photo-transistor 170*b* changes corresponding to the transmittance. In other words, the transmittance of an original D is detected by the light quantity which reaches photo-transistor 170*b*.

Figure 8:
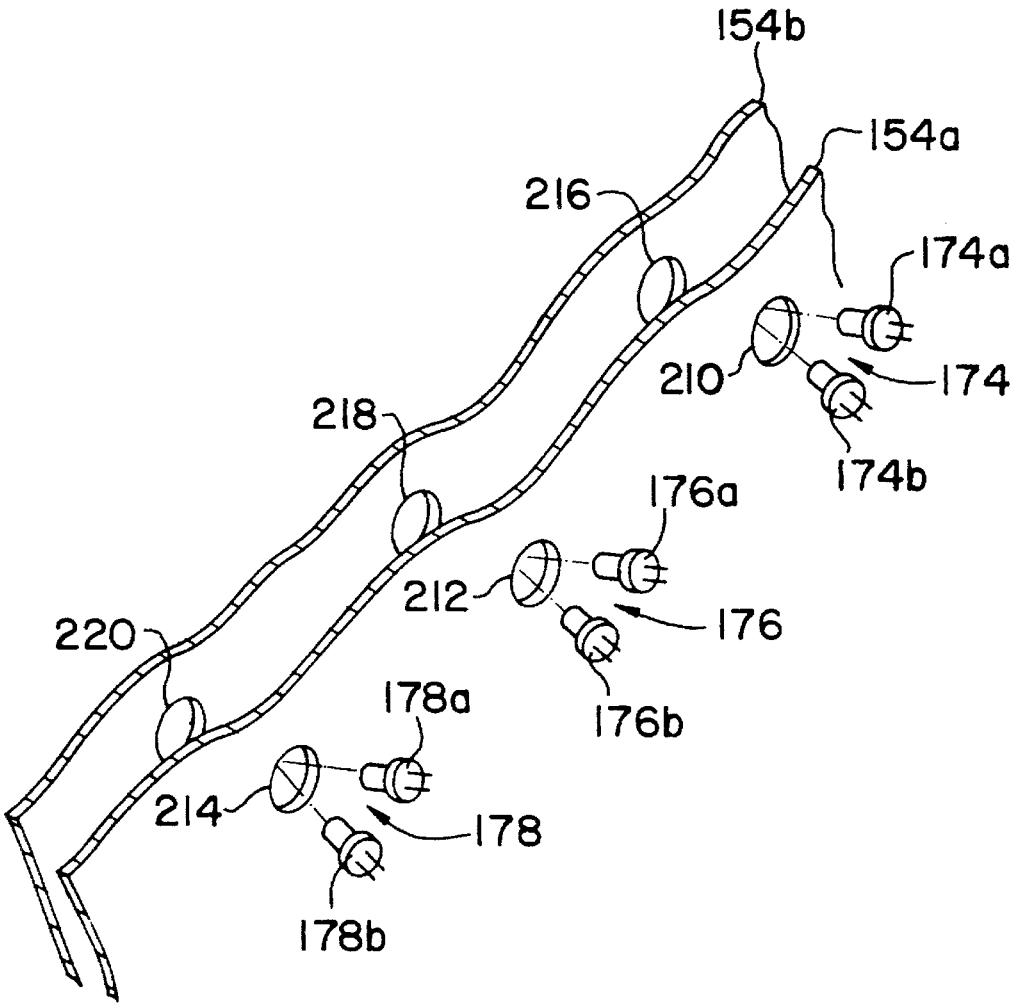
FIG. 8 is a perspective view schematically showing arrangements of the image-detecting sensors.

As shown in FIG. 8, image-detecting sensors 174,176, and 178 include a light-emitting diode 174*a* and a photo-transistor 174*b* , a light-emitting diode 176*a* and a photo-transistor 176*b*, and a light-emitting diode 178*a* and a photo-transistor 178*b*, respectively. Holes 210, 212, and 214 are formed in guide 154*a*, and holes 216, 218, and 220 are formed in guide 154*b*. Holes 210 and 216 correspond to image-detecting sensor 174, holes 212 and 218 correspond to image-detecting sensor 176, and holes 214 and 220 correspond to image-detecting sensor 178. When there is no original D between guides 154*a* and 154*b*, each of the light from light-emitting diodes 174*a*, 176*a*, and 178*a* goes through, respectively, holes 210, 212, 214, 216, 218, and 220. On the contrary, when an original D is guided by guides 154a and 154b, so as to position between holes, each of the lights from light-emitting diodes 174a, 176a, and 178a is reflected by the original D, and reaches photo-transistors 174b, 176b, and 178b, respectively. If there is an image on the reflecting surface of original D, the light quantity reflected by the image portion is low level, and the light quantity reflected by a non-image portion is high level. If there is no image on the reflecting surface, the light quantity reflected by the original D does not change so much. Therefore, image-detecting sensors 174, 176, and 178 may detect that the reflecting surface has an image by monitoring the change in the light quantity.

Each of image-detecting sensors 174, 176, and 178 is arranged near guide 154a so as to correspond to the right portion, the central portion, and the left portion of an original D transported, respectively. This arrangement is for detecting the absence and the presence with high accuracy. The more the number of the detected portions are, the higher the accuracy of detection is. Thus, it is desirable to increase the number of the detected portions, if possible.

An exposure control system of copying machine 2 is described in detail below. The control system can be placed at a convenient location.

Figure 9:
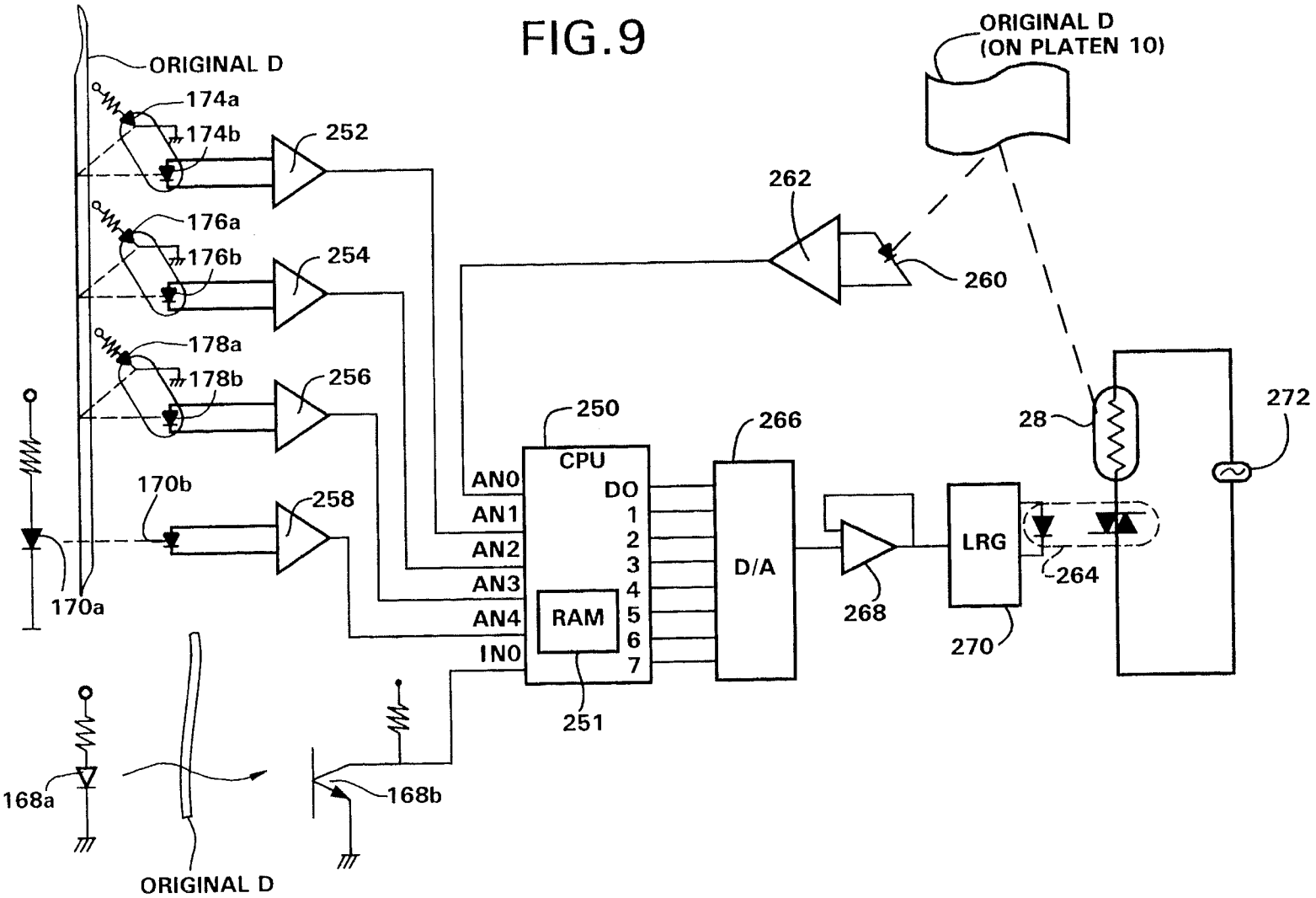
FIG. 9 is a circuit diagram showing an exposure control system of the image-forming apparatus.

As shown in FIG. 9, the exposure control system has a CPU 250 which controls the exposure control system. CPU 250 includes a RAM 251. Photo-transistors 174b, 176b, 178b and 170b couple to input ports AN1, AN2, AN3, and AN4 of CPU 250 through amplifiers 252, 254, 256, and 258 for converting a current to a voltage, respectively. Photo-transistor 168b couples to an input port IN0 of CPU 250. Furthermore, a photo-diode 260 couples to an input port AN0 of CPU 250 through an amplifier 262 for converting a current to a voltage. Photo-diode 260 receives the light reflected from an original D placed on platen 10, and outputs a current corresponding to the light quantity so as to optimize the density of a copy image independent of the density of the original D. This art is disclosed by U.S. Pat. No. 4,573,787. This art, however, does not prevent the image of the opposite surface of an original D from being copied when the transmittance of the original D is high.

A triac 264 couples to output ports of CPU 250 through a D/A converter 266, an amplifier 268, and a lamp regulator 270 so as to regulate the voltage applied to exposure lamp 28 which couples to an AC voltage source 272.

Figure 10A:
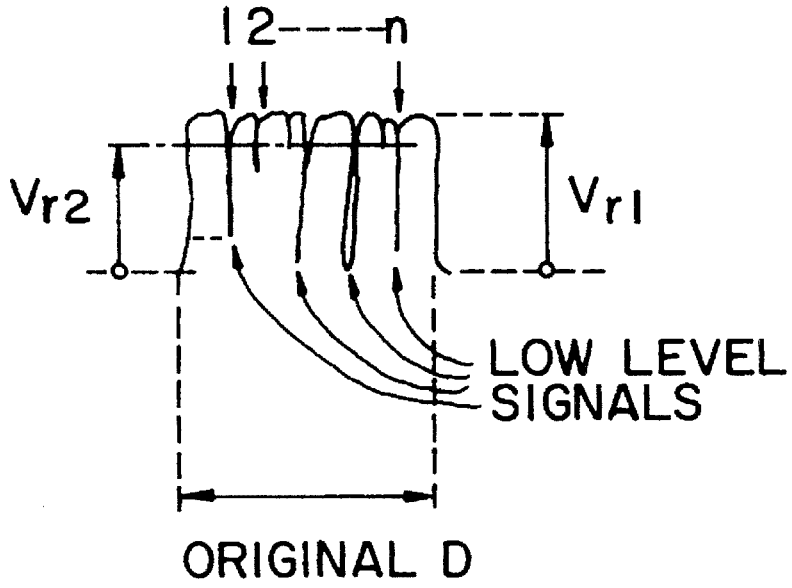
FIGS. 10(*a*) and 10(*b*) are wave forms which correspond to outputs from the transmittance sensor and the image-detecting sensors.
Figure 10B:
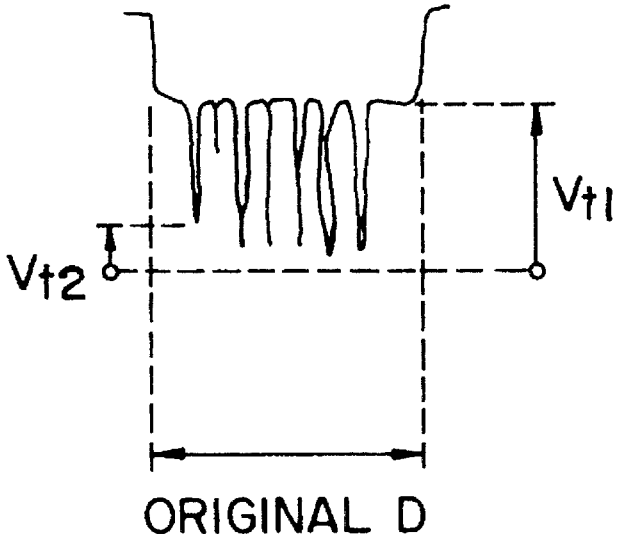

As described above, each of input port AN1, AN2, and AN3 receives voltage signals which correspond to the outputs from photo-transistor 174b, 176b, and 178b. As shown in FIG. 10(*a*), when there is an image on the opposite surface of an original D, each of the voltage signals has a high level signal $V_{r1}$ and a low level signal lower than the high level signal. The low level signal which corresponds to a high density area of an original D may correspond to the image portion, and may just be noise. A threshold voltage level $V_{r2}$ is predetermined so as to determine that the low level signal corresponds to the image portion. If the low level signal is lower than threshold voltage level $V_{r2}$, CPU 250 counts the number "n" of the low level signals. If the number "n" is more than a predetermined number, then CPU 250 determines that there is an image on the surface.

Input port AN4 receives a voltage signal on the basis of the output from photo-transistor 170b. As shown in FIG. 10(*b*), if there is an image on, at least one of the front surface of an original D and the opposite surface, the voltage signal has a high level signal $V_{t1}$ and a low level signal $V_{r2}$. High level signal $V_{t1}$ corresponds to the non-image area, and low level signal $V_{t2}$ may correspond to the image portion. High level signal $V_{t1}$ is used for the exposure control, because it represents the transmittance of the original D.

An operation of the exposure control system will be described below with reference to flow charts shown in FIGS. 11(*a*) and 11(*b*).

After automatic-document feeder 4 starts to transport original D, CPU 250 starts to detect the voltage value of high level signal $V_{t1}$ input to input port AN4 when aligning sensor 168 has detected original D transported (steps ST1 and ST2). Since aligning roller pair 172 takes about 100 msec to transport original D from aligning roller pair 172 to image-detecting sensors 174, 176, and 178, CPU 250 starts to count each number "n" of low level signals input to input ports AN1, AN2, and AN3 at 100 msec after aligning roller pair 172 starts to rotate (steps ST3 and ST4). CPU 250 continues this counting operation until 100 msec elapse after aligning sensor 168 has changed without detecting original D (steps ST5 and ST6). After that, CPU 250 checks that the number "n" counted in step ST4 is the predetermined number, for example "5" or more, as for each of the input signals input to input parts AN1, AN2, and AN3 (steps ST7, ST8, and ST9).

Figure 12:
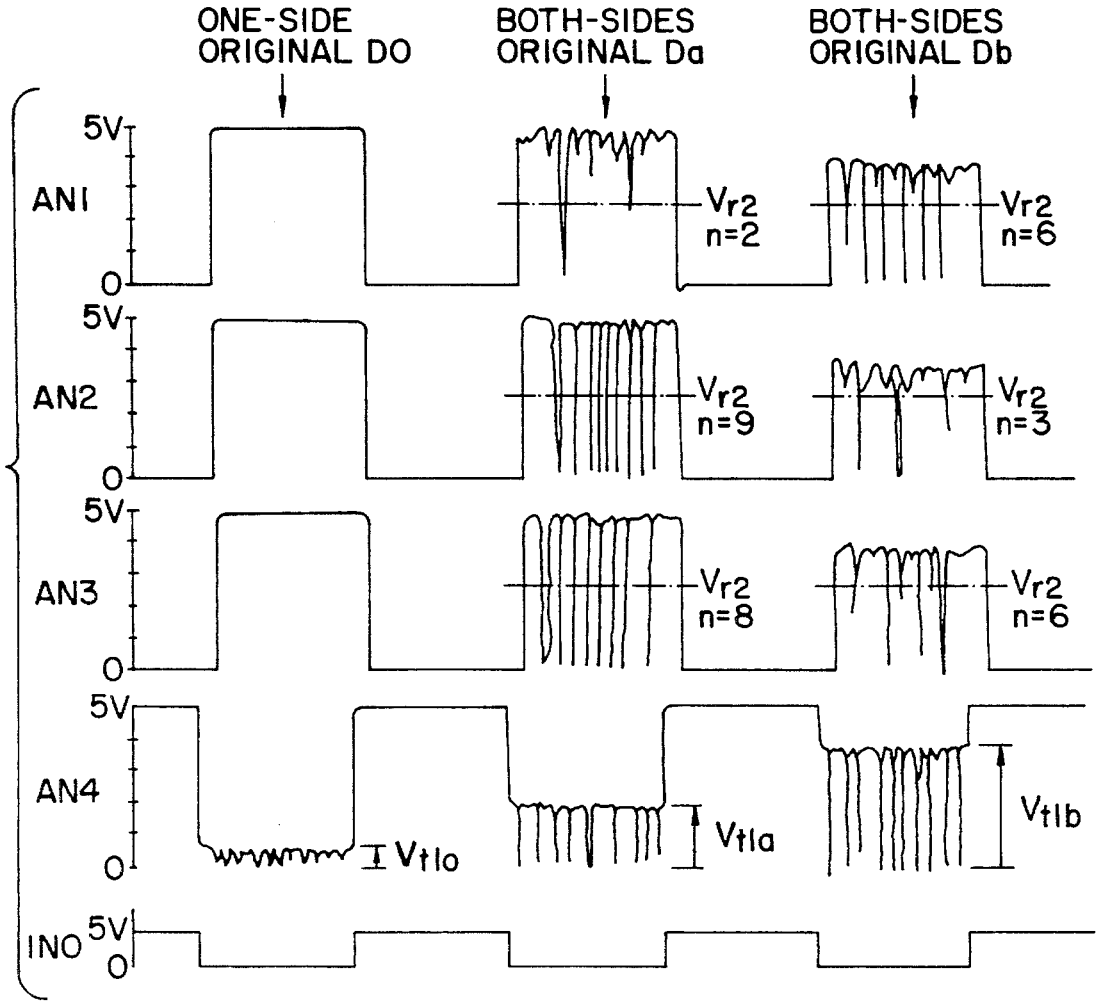
FIG. 12 is a wave diagram showing wave forms input to parts of a CPU in the exposure control system.

As shown in FIG. 12, if an original D is a so-called one-side original Do, wave forms of signals which input ports AN1, AN2, and AN3 receive are nearly flat, the number "n" is less than the predetermined number in almost all the cases. A voltage value $Vt_{10}$ of high level signal $V_{t1}$ depends on the transmittance of the original D, irrespective of whether it is one-side original.

On the contrary, if an original D is a so-called two-sided original Da or Db, input ports AN1, AN2, and AN3 receive high level signals and low level signals which are lower than the high level signals, respectively. CPU 250 counts the number "n" of the low level signals which are lower than the threshold voltage level $V_{r2}$. In this case, as for the original Da, each number "n" of the signals input to input ports AN1, AN2, and AN3 is "2", "9", and "8", respectively As for the original Db, each number "n" of the signals input to input ports AN1, AN2, and AN3 is "6", "3", and "6" respectively.

Figure 11A:
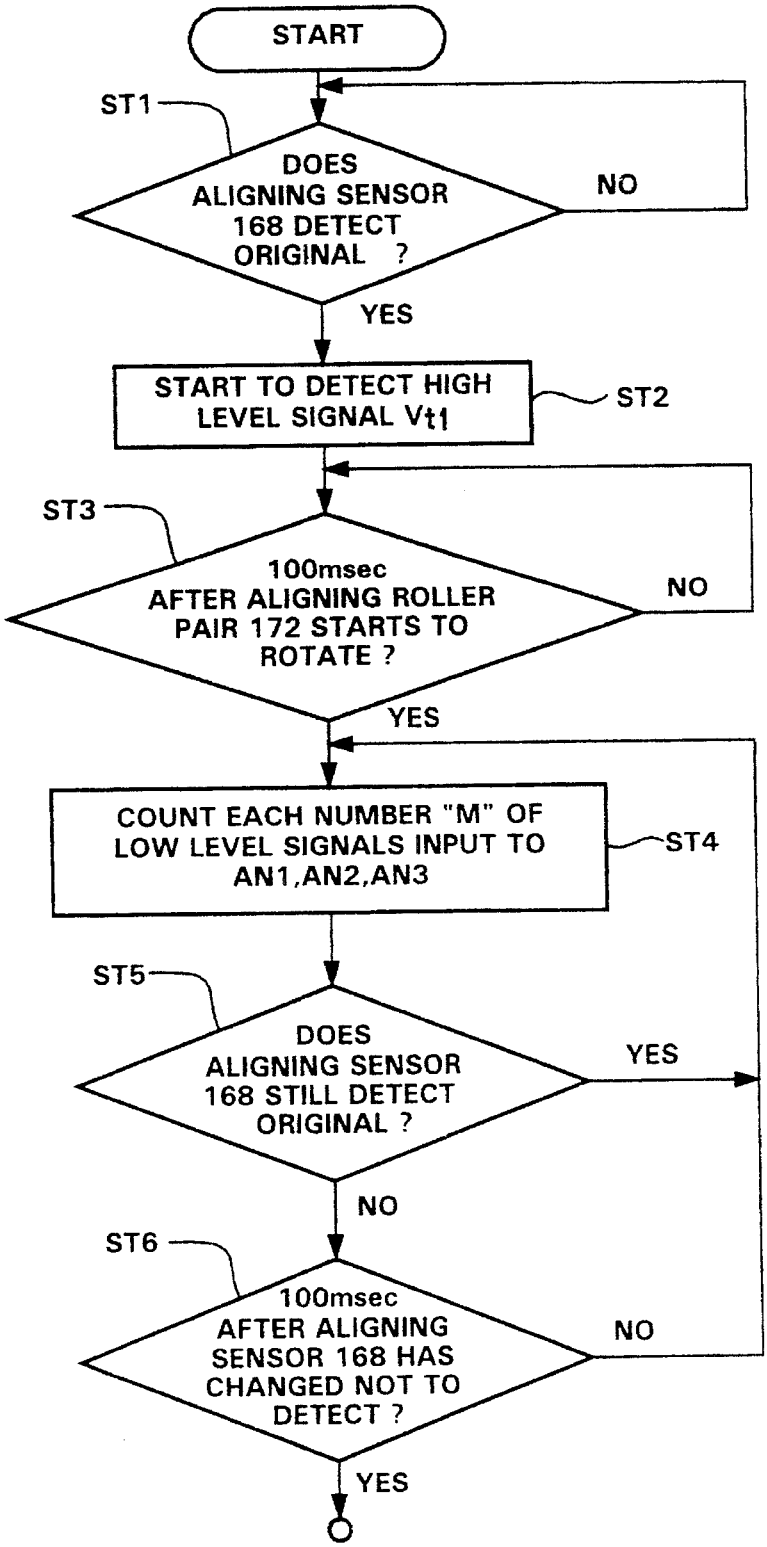
FIGS. 11 (*a*) and 11(*b*) are flow charts for illustrating the operation of the exposure control system.
Figure 11B:
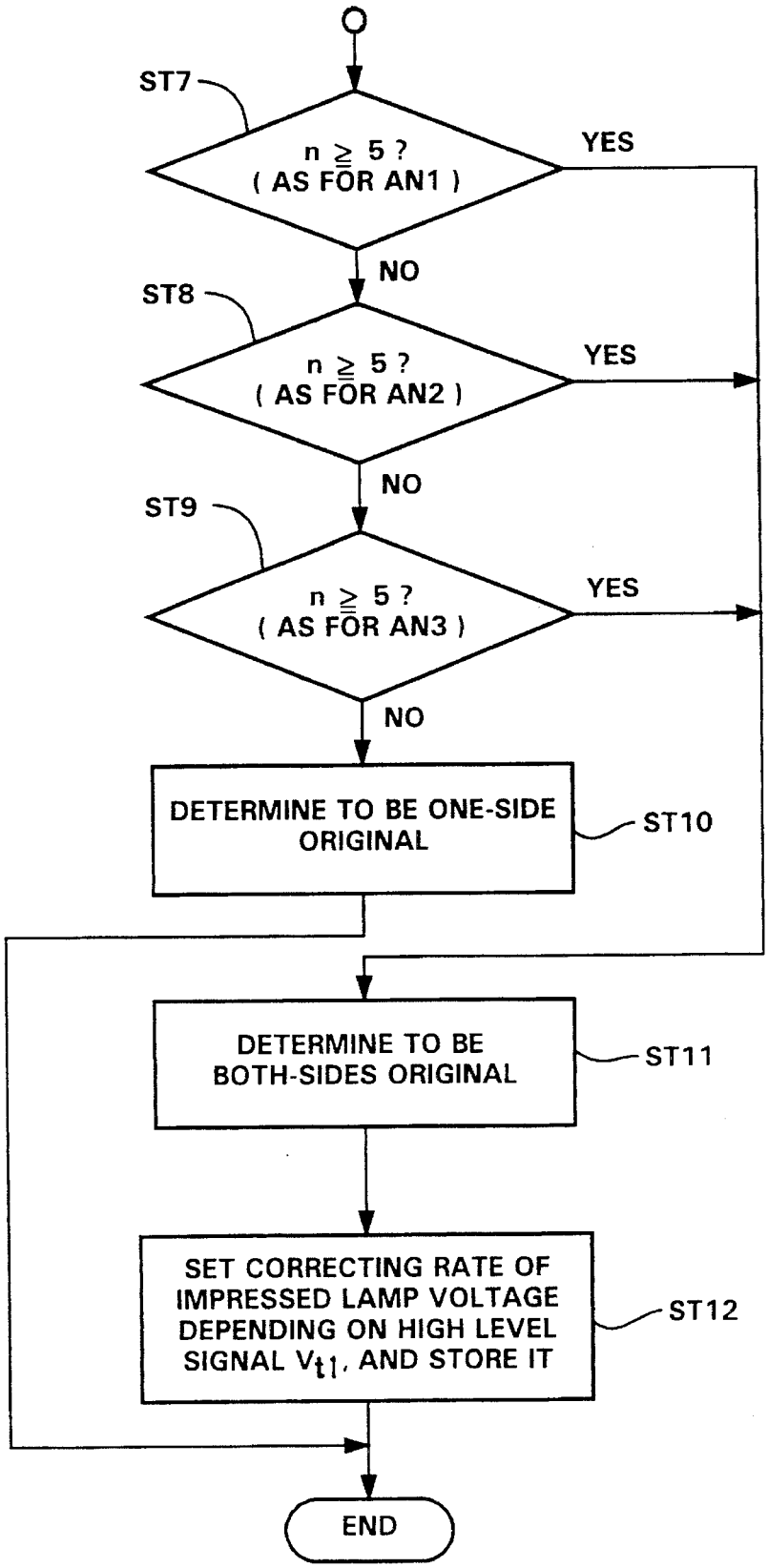

If at least one of each number "n" is "5" or more at steps ST7 to ST9 in FIG. 11(*b*), such as original Da or original Db, CPU 250 determines that the original D is a two-sided original and if no one of them is "5" or more, such as original Db, CPU 250 determines that the original D is one-side original (steps ST10 and ST11).

When the original D is determined to be a two-sided original, CPU 250 determines the voltage value of high level signal $V_{t1}$ which is input to input port AN4, and sets a correcting rate α of an impressed lamp voltage to exposure lamp 28 depending on the voltage value and stores the correcting rate α in RAM 251 (step ST12). The voltage value depends on the transmittance of original D which changes on the basis of the material, the thickness, and so on. For example, the voltage value $V_{t1a}$ in relation to original Da differs from the voltage value $V_{t1b}$ in relation to original Db.

Figure 13:
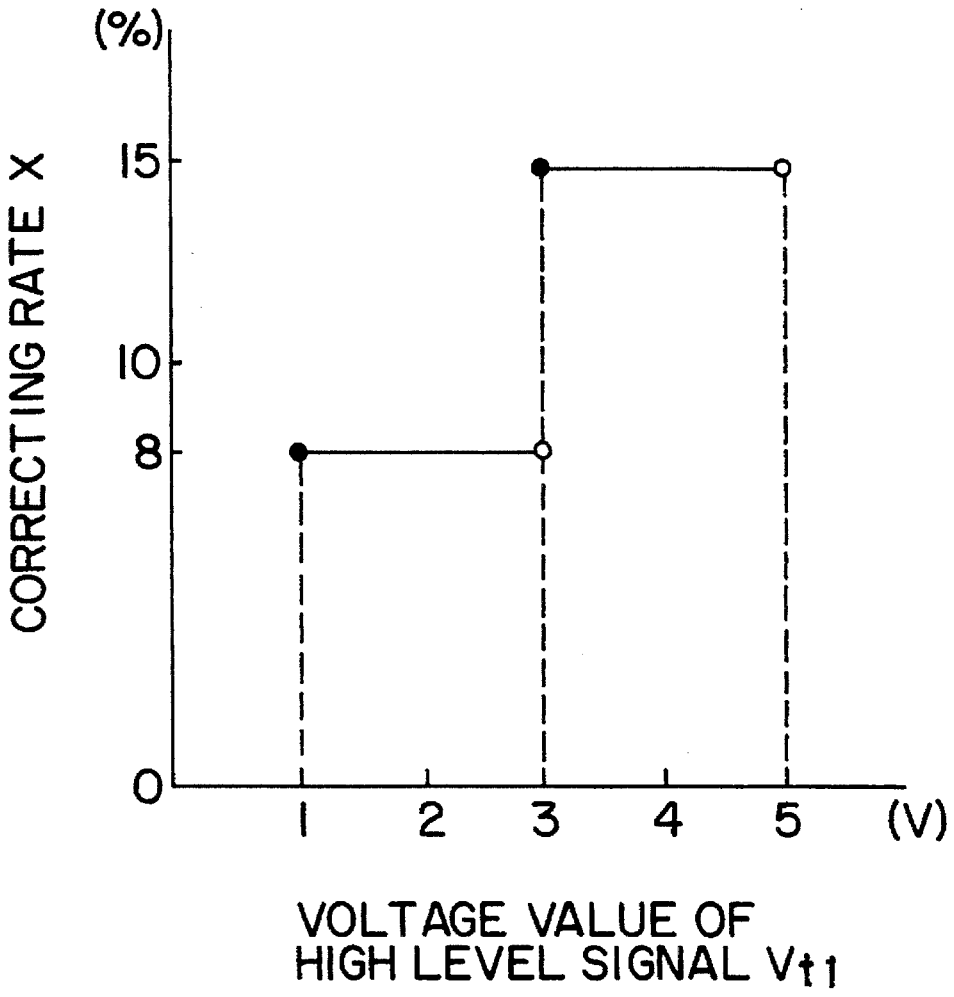
FIG. 13 is a graph showing the relation between the output of the transmittance sensor and a correcting rate.

The correcting rate is decided as shown in FIG. 13, namely, when the voltage value $V_{t1x}$ is $0\ V \leqq V_{t1x} < 1\ V$, the correcting rate α is 0%. In the same way, when the voltage value $V_{t1x}$ is $1\ V \leqq V_{t1x} < 3\ V$, the correcting rate α is 8%, and when the voltage value $V_{t1x}$ is $3\ V \leqq V_{t1x} \leqq 5$, the correcting rate α is 15%. When the correcting rate α is set, the output voltage of amplifier 268 is corrected in accordance with the correcting rate α. The output voltage is decided as follows:

$$f(AN0)+C\times\alpha$$

wherein, f (AN0) is a conventional-type function so as to automatically optimize the density of a copy image corresponding to the current input to input port AN0, C is a constant, and α is the correcting rate. Therefore, the exposure light intensity is adjusted by a collecting value which is represented as "C×α".

Figure 14:
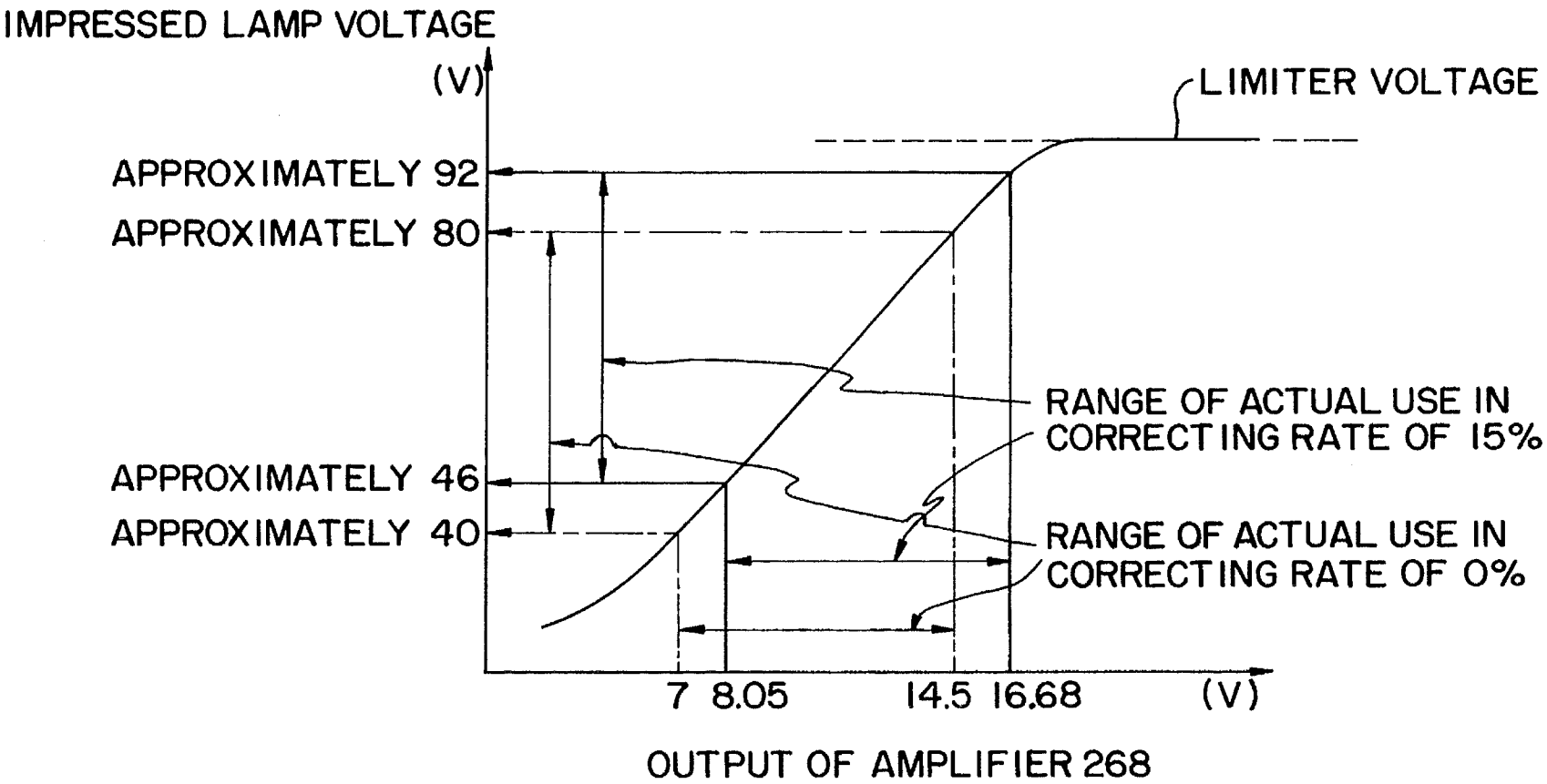
FIG. 14 is a graph showing the difference between the correcting rate of 0% and the correcting rate of 15%.

As shown in FIG. 14, when the correcting rate is 15%, each range of the output of amplifier 268 and the impressed lamp voltage is shifted to a higher level than each range of those in the correcting rate of 0%.

Then, if automatic-document feeder 4 reverses the original D and sets the original D so that the opposite surface of the original D is down, CPU 250 performs the exposure control operation on the basis of the correcting rate α stored in RAM 251 in step ST12.

In this way, when the original D is a two-sided original, the exposure light quantity is adjusted to an optimum level corresponding to the transmittance of the original D.

The present invention may be embodied in other specific forms without departing from the spirit or essential characteristics thereof. The presently described embodiments are therefore to be considered in all respects as illustrative and not restrictive. The scope of the present invention is indicated by the appended claims rather than by the foregoing description, and all changes which come within the meaning and range of equivalency of the claims are therefore intended to be embraced therein.

What is claimed is:

1. An image forming apparatus, comprising:

a platen on which an original is placed so that a first surface of the original is positioned at an exposure area;

first detecting means for detecting that a second surface of the original which is opposite to the first surface, has an image;

second detecting means for detecting a transmittance of the original;

exposure means for exposing the first surface positioned at the exposure area by emitting a light to make a light image;

means for adjusting an intensity of the light emitted by the exposure means corresponding to the transmittance when the first detecting means detects that the second surface has the image; and means for forming a copying image on the basis of the light image, wherein the first detecting means includes means for outputting predetermined signals corresponding to a high density area of the second surface of the original, means for counting the number of the predetermined signals, and means for determining that the second surface has the image when the counted number is more than a predetermined number.

2. An image forming apparatus, comprising:

a platen on which an original is placed so that a first surface of the original is positioned at an exposure area;

a first sensor for detecting that a second surface of the original which is opposite to the first surface, has an image;

a second sensor for detecting a transmittance of the original;

an exposure lamp which is arranged near the platen to expose the first surface positioned at the exposure area to form a light image;

a voltage source coupled to the exposure lamp;

a control unit for adjusting the voltage applied from the voltage source to the exposure lamp corresponding to the transmittance whenever the first sensor detects that the second surface has the image; and an image forming unit for forming a copying image on the basis of the image, wherein the first sensor comprises a light-emitting diode for emitting a light to the second surface, a photo-transistor for receiving a reflected light reflected by the second surface to output predetermined signals corresponding to a high density area of the second surface, means for counting the number of the predetermined signals, and means for determining that the second surface has the image when the counted number is more than a predetermined number.

* * * * *